United States Patent [19]

Ishibashi et al.

[11] Patent Number: 5,047,706

[45] Date of Patent: Sep. 10, 1991

[54] CONSTANT CURRENT-CONSTANT VOLTAGE CIRCUIT

[75] Inventors: Koichiro Ishibashi, Tokyo; Katsuro Sasaki, Fuchu; Katsuhiro Shimohigashi, Musashimurayama, all of Japan

[73] Assignee: Hitachi, Ltd., Tokyo, Japan

[21] Appl. No.: 577,512

[22] Filed: Sep. 5, 1990

[30] Foreign Application Priority Data

Sep. 8, 1989 [JP] Japan ..... 1-231569

[51] Int. Cl.[5] ..... G05F 3/24

[52] U.S. Cl. ..... 323/313; 323/315; 323/907

[58] Field of Search ..... 323/312, 313, 314, 315, 323/316, 901, 907; 307/296.1, 296.5, 296.8

[56] References Cited

U.S. PATENT DOCUMENTS

| | | | |
|---|---|---|---|
| 4,446,383 | 5/1984 | Concannon et al. | 323/313 |
| 4,454,467 | 6/1984 | Sakaguchi | 323/313 |
| 4,654,578 | 3/1987 | Salerno et al. | 323/313 |
| 4,694,199 | 9/1987 | Goetz | 323/313 |
| 4,769,589 | 9/1988 | Rosenthal | 323/315 |
| 4,935,690 | 6/1990 | Yan | 323/314 |

FOREIGN PATENT DOCUMENTS 58-22423 2/1983 Japan .

*Primary Examiner*—Peter S. Wong

*Attorney, Agent, or Firm*—Antonelli, Terry, Stout & Kraus

[57] ABSTRACT

In a constant current-constant voltage circuit disclosed herein, gates of MOSFETs $Q_1$ and $Q_2$ are connected together, and the gate of the MOSFET $Q_1$ is connected to the drain thereof. Further, the source of the MOSFET $Q_1$ is connected to ground potential GND whereas the source of the MOSFET $Q_2$ is connected to the drain of a MOSFET $Q_3$ having a gate connected to power supply voltage $V_{DD}$ and a source connected to the ground voltage GND. A current mirror circuit including $Q_4$ and $Q_5$ has an input and an output respectively connected to the drain of the second MOSFET $Q_2$ and the drain of the first MOSFET $Q_1$. A first coefficient ($W_3L_2/L_3W_2$) depending upon channel lengths ($L_2$, $L_3$) and channel widths ($W_2$, $W_3$) of the MOSFETs $Q_2$ and $Q_3$ is set at a value not larger than a predetermined value. Therefore, the MOSFET $Q_3$ operates in a linear region as high resistance, and the MOSFETs $Q_1$ and $Q_2$ operate in a sub-threshold region. As a result, the dependence upon temperature is significantly improved.

4 Claims, 3 Drawing Sheets

CONSTANT CURRENT-CONSTANT VOLTAGE CIRCUIT

BACKGROUND OF THE INVENTION

The present invention relates to a constant current-constant voltage circuit, and in particular to a constant current-constant voltage circuit in a semiconductor integrated circuit including integrated MOSFETs.

A reference voltage generator as shown in FIG. 2 is disclosed in U.S. Pat. No. 4,454,467 corresponding to Japanese patent application laid-open No. JP-A-58-22423.

That is to say, the known reference voltage generator shown in FIG. 2 includes N-channel MOSFETs $Q_1$ and $Q_2$ having gates connected together, an N-channel MOSFET $Q_3$ having a gate connected to its drain, and P-channel MOSFETs $Q_4$ and $Q_5$ forming a current mirror circuit. The threshold voltage $V_{th1}$ of the N-channel MOSFET $Q_1$ is so set as to have a large value whereas the threshold voltage $V_{th2}$ of the N-channel MOSFET $Q_2$ is so set as to have a small value. Therefore, it is possible to derive a threshold voltage difference $V_{th1}-V_{th2}=\Delta V_{th}$ at an output terminal $T_o$ as output voltage $V_{out}$.

This threshold voltage difference $\Delta V_{th}$ obtained at the output terminal $T_o$ becomes constant irrespective of a change in supply voltage $V_{DD}$ and a temperature change.

SUMMARY OF THE INVENTION

The present inventors studied derivation of a constant current by using the output voltage Vout generated by the above described reference voltage generator of the prior art. It was thus revealed that the following problem was posed.

The output voltage Vout obtained at the output terminal $T_o$ of the reference voltage generator shown in FIG. 2 is applied to the gate of an N-channel MOSFET $Q_6$, the source of which is grounded. It is thus possible to let flow a constant current $I_{Q6}$ through the drain of the MOSFET $Q_6$.

As the temperature changes, however, the characteristic of the MOSFET $Q_6$ changes. As a result, the value of the drain current $I_{Q6}$ of this MOSFET $Q_6$ changes.

The present invention is based upon the result of such study made by the present inventors. An object of the present invention is to provide a constant current-constant voltage circuit which does not largely depend upon the temperature.

A constant current-constant voltage circuit in a typical implementation form of the present invention includes (1) first and second MOSFETs ($Q_1$, $Q_2$) having gates connected together;

(2) a third MOSFET ($Q_3$) having a drain-source path connected to a source of the above described second MOSFET ($Q_2$);

(3) a current mirror circuit ($Q_4$, $Q_5$) having an input connected to a drain of the above described second MOSFET ($Q_2$) and an output connected to a drain of the above described first MOSFET ($Q_1$);

the gate of the above described first MOSFET ($Q_1$) being connected to the drain thereof;

a gate of the above described third MOSFET ($Q_3$) being connected to a predetermined operating potential point ($V_{DD}$) to make the above described third MOSFET ($Q_3$) operate in a linear region; and a first coefficient $W_3L_2/L_3W_2$) depending upon channel lengths ($L_2$, $L_3$) and channel widths ($W_2$, $W_3$) of the above described second and third MOSFETs ($Q_2$, $Q_3$) being set at a value not larger than a predetermined value.

Since the gate of the third MOSFET ($Q_3$) is connected to the predetermined potential point ($V_{DD}$), the third MOSFET ($Q_3$) operates in the linear region. Since the coefficient $W_3L_2/L_3W_2$) is set at a value not larger than the predetermined value, the third MOSFET ($Q_3$) operates as high resistance.

Since voltage not larger than the threshold voltage Vth is applied between the gate and source of the second MOSFET ($Q_2$) having the source connected to the third MOSFET ($Q_3$) operating as the high resistance, the second MOSFET ($Q_2$) operates in the so-called subthreshold region in which a minute current flows.

The current flowing through the second MOSFET ($Q_2$) operating in the sub-threshold region tends to increase with a rise in temperature. Since the third MOSFET ($Q_3$) having the drain-source path connected in series with the drain-source path of the second MOSFET ($Q_2$) operates in a large current operating region located outside of the sub-threshold region, however, the current flowing through the third MOSFET ($Q_3$) which operates in the large current operating region tends to decrease with a rise in temperature. In this way, the dependence of the current of the second MOSFET ($Q_2$) upon temperature cancels the dependence of the current of the third MOSFET ($Q_3$), which has the drain-source path connected in series with that of the second MOSFET ($Q_2$), upon temperature. Irrespective of a temperature change, therefore, the current flowing through the series paths of the second MOSFET ($Q_2$) and the third MOSFET ($Q_3$) can be kept substantially constant.

The MOSFET ($Q_3$) of the prior art shown in FIG. 2 operates in a saturation region because of short-circuit connection between the gate and the drain. On the other hand, the third MOSFET ($Q_3$) of the present invention operates in the linear region as high resistance as described above, resulting in a significant feature.

Other features and other objects of the present invention will become apparent from the preferred embodiments described below.

DESCRIPTION OF THE PREFERRED EMBODIMENTS

Embodiments of the present invention will hereafter be described by referring to drawings.

Figure 1:
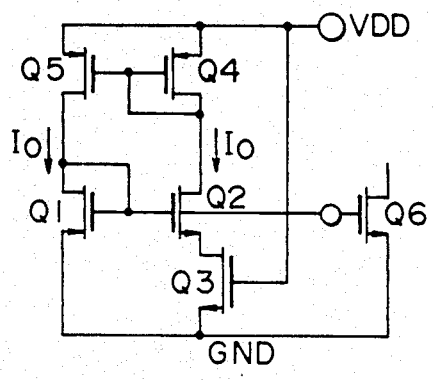
FIG. 1 is a circuit diagram of a constant current-constant voltage circuit according to an embodiment of the present invention.
Figure 2:
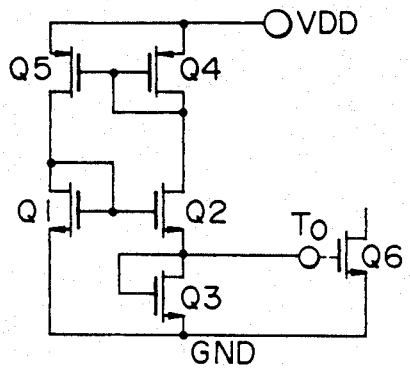
FIG. 2 PRIOR ART
FIG. 2 is a circuit diagram of the prior art.

FIG. 1 shows a constant current-constant voltage circuit according to an embodiment of the present invention. In FIG. 1, gates of first and second N-channel MOSFETs $Q_1$ and $Q_2$ are connected together. The gate of the first N-channel MOSFET $Q_1$ is connected to the drain thereof. The source of the first N-channel MOSFET $Q_1$ is connected to ground voltage GND. The source of the second MOSFET $Q_2$ is connected to the drain of the third N-channel MOSFET $Q_3$. The gate of the third MOSFET $Q_3$ is connected to power supply voltage $V_{DD}$. The source of the third MOSFET $Q_3$ is connected to ground voltage GND. The input and output of a current mirror circuit including $Q_4$ and $Q_5$ are connected to the drain of the second MOSFET $Q_2$ and the drain of the first MOSFET $Q_1$, respectively.

Channel length $L_1$ of the first MOSFET $Q_1$ is so set as to be equal to channel length $L_2$ of the second MOSFET $Q_2$. Channel width $W_2$ of the second MOSFET $Q_2$ is so set as to be K times (10 or 100) channel width $W_1$ of the first MOSFET $Q_1$.

As described later in detail, a second coefficient K ($=W_2L_1/W_1L_2$) depending upon the channel widths ($W_1$, $W_2$) and channel lengths ($L_1$, $L_2$) of the first and second MOSFETs $Q_1$ and $Q_2$ has important meaning in the embodiment of the present invention.

Since the gate of the third N-channel MOSFET $Q_3$ of enhancement type is connected to the power supply voltage $V_{DD}$, the third MOSFET operates in the linear region.

Further, a first coefficient ($W_3L_2/L_3W_2$) depending upon the channel length $L_2$ of the second MOSFET $Q_2$, the channel length $L_3$ of the third MOSFET $Q_3$, the channel width $W_2$ of the second MOSFET $Q_2$ and the channel width $W_3$ of the third MOSFET $Q_3$ is so set as to have a value not larger than a predetermined value. Therefore, the third MOSFET $Q_3$ operates as high resistance.

Channel lengths $L_4$ and $L_5$ of fourth and fifth P-channel MOSFETs $Q_4$ and $Q_5$ forming the current mirror circuit are so set as to be equal. Channel widths $W_4$ and $W_5$ of the fourth and fifth P-channel MOSFETs $Q_4$ and $Q_5$ are so set as to be equal. Since the gate of the fourth MOSFET $Q_4$ is connected to the drain thereof, voltage proportionate to the current flowing through the drain-source path of the fourth MOSFET $Q_4$ is generated between the source and gate of the fourth MOSFET $Q_4$. Since this voltage is applied between the source and gate of the fifth MOSFET $Q_5$, a current equivalent to the current flowing through the drain-source path of the fourth MOSFET $Q_4$ flows through the drain-source path of the fifth MOSFET $Q_5$.

Therefore, the drain of the fourth MOSFET $Q_4$ and the drain of the fifth MOSFET $Q_5$ function as the input and output of the current mirror circuit, respectively. A current $I_o$ equivalent to the current $I_o$ flowing at the input thus flows at the output.

Therefore, the second MOSFET $Q_2$, the source of which is connected to the third MOSFET $Q_3$ functioning as high resistance, operates in a sub-threshold region. As a result, the current $I_o$ flowing through the second MOSFET $Q_2$ becomes a minute current. A current equivalent to this minute current $I_o$ is let flow through the first MOSFET $Q_1$ connected to the output of the current mirror circuit. Therefore, the first MOSFET $Q_1$ also operates in the sub-threshold region.

As the temperature rises, the current flowing through the second MOSFET $Q_2$, which operates in the sub-threshold region, tends to increase. Since the third MOSFET $Q_3$ having a drain-source path connected in series with the drain-source path of the second MOSFET $Q_2$ operates in a large current operating region located outside of the sub-threshold region, however, the current flowing through the third MOSFET $Q_3$ operating in the large current operating region tends to decrease with a rise in temperature. In this way, the dependence of the current of the second MOSFET $Q_2$ upon temperature cancels the dependence of the current of the third MOSFET $Q_3$, which has the drain-source path connected in series with that of the second MOSFET $Q_2$, upon temperature. Irrespective of a temperature change, therefore, the current flowing through the series paths of the second MOSFET $Q_2$ and the third MOSFET $Q_3$ can be kept substantially constant.

Assuming that the common connection gate of the first and second N-channel MOSFETs $Q_1$ and $Q_2$ is an output terminal $T_o$, therefore, voltage $V_{out}$ generated at this output terminal $T_o$ becomes substantially constant irrespective of a change in power supply voltage $V_{DD}$. By applying the output voltage Vout obtained at the output terminal $T_o$ to the gate of the N-channel MOSFET $Q_6$ and grounding the source of the MOSFET $Q_6$, therefore, a constant current $I_{Q6}$ can be let flow through the drain of the MOSFET $Q_6$.

Figure 3:
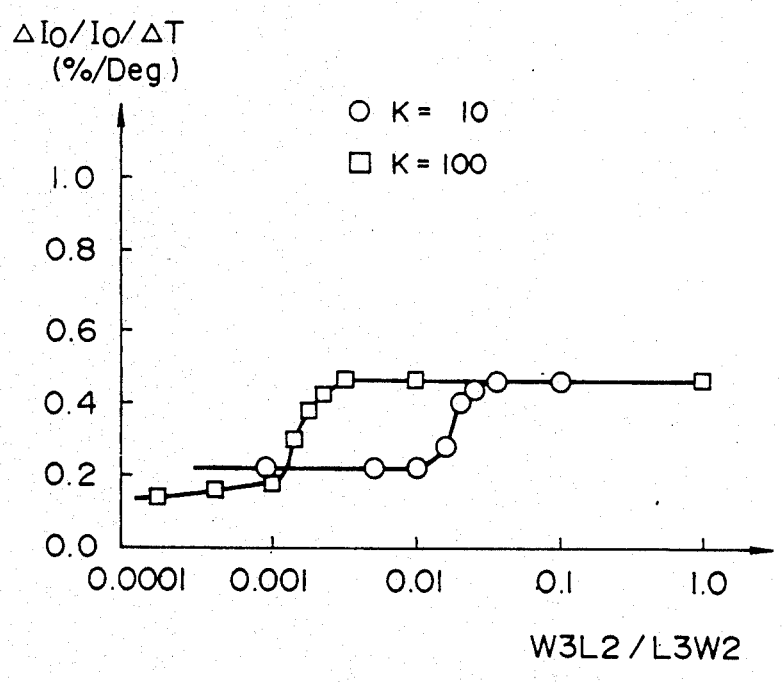
FIG. 3 is a characteristic diagram showing the dependence of the embodiment of FIG. 1 upon temperature.

FIG. 3 is a plot of dependence $\Delta I_o/I_o/\Delta T$ %/degree of the current $I_o$ upon temperature as a function of the first coefficient $W_3L_2/L_3W_2$ under the condition that power supply voltage $V_{DD}$ of the constant current-constant voltage circuit shown in FIG. 1 is 3 volts and the second coefficient K ($=W_2L_1/W_1L_2$) is 10 or 100.

It is understood from FIG. 3 that the co-efficient $W_3L_2/L_3W_2$ should be set at a value not larger than 0.1 when the dependence $\Delta I_o/I_o/\Delta T$ of the current $I_o$ upon temperature is to be equivalent to or less than 0.45 %/degree.

In the same way, it is understood from the characteristic with the second coefficient K ($=W_2L_1/W_1L_2$) being equivalent to 10 or 100 that product $KW_3L_2/L_3W_2$ of the first coefficient $W_3L_2/L_3W_2$ and the above described second coefficient K should be set at 0.1 or less when the dependence $\Delta I_o/I_o/\Delta T$ of the current $I_o$ upon temperature is to be equivalent to or less than 0.25 %/degree.

Figure 4:
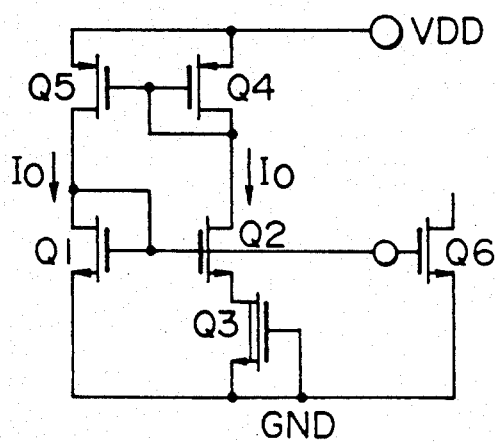
FIG. 4 is a circuit diagram of a constant current-constant voltage circuit according to another embodiment of the present invention.

FIG. 4 is a circuit diagram of a constant current-constant voltage circuit according to another embodiment of the present invention. The embodiment of FIG. 4 differs from the embodiment of FIG. 1 in that the third MOSFET $Q_3$ is the depletion type instead of the enhancement type and the gate of the third MOSFET $Q_3$ is connected to the ground potential GND as a result of the change in type of the MOSFET $Q_3$.

Figure 5:
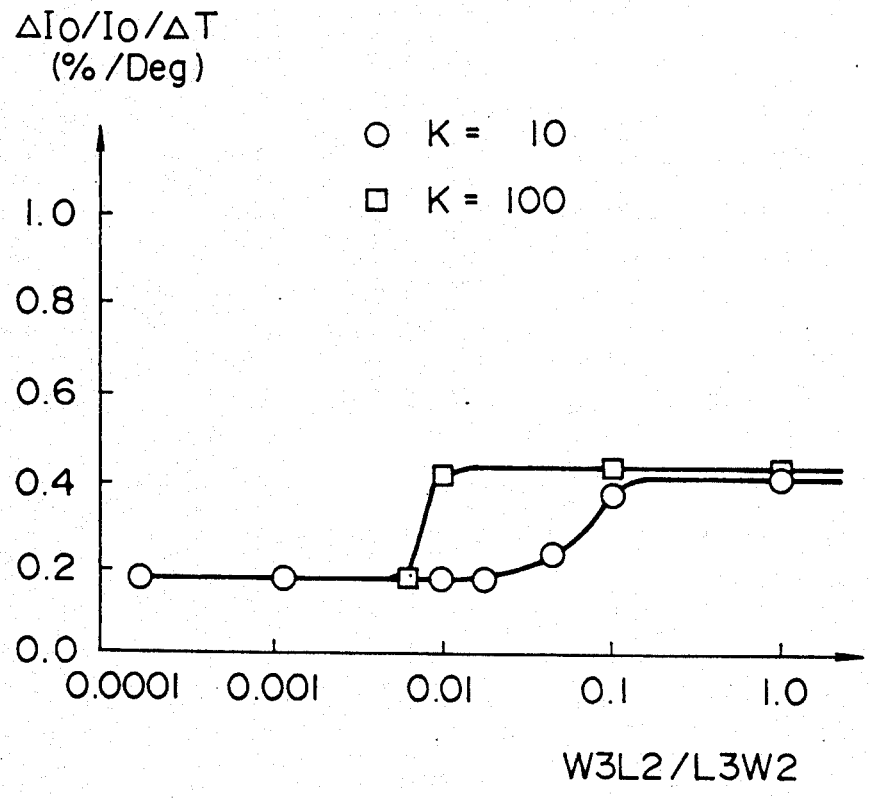
FIG. 5 is a characteristic diagram showing the dependence of the embodiment of FIG. 4 upon temperature.

FIG. 5 is a plot of dependence $\Delta I_o/I_o/\Delta T$ %/degree of the current $I_o$ current temperature as a function of the first coefficient $W_3L_2/L_3W_2$ under the condition that the power supply voltage $V_{DD}$ of the constant current-constant voltage circuit shown in FIG. 4 is 3 volts and the second coefficient K ($=W_2L_1/W_1L_2$) is 10 or 100.

It is understood from FIG. 5 that the co-efficient $W_3L_2/L_3W_2$ should be set at a value not larger than 0.1 when the dependence $\Delta I_o/I_o/\Delta T$ of the current $I_o$ upon temperature is to be equivalent to or less than 0.45 %/degree.

In the same way, it is understood from the characteristic with the second coefficient K ($=W_2L_1/W_1L_2$) being equivalent to 10 or 100 that product $KW_3L_2/L_3W_2$ of the first coefficient $W_3L_2/L_3W_2$ and the above described second coefficient K should be set at 0.4 or less when the dependence $\Delta I_o/I_o/\Delta T$ of the current $I_o$ upon temperature is to be equivalent to or less than 0.3 %/degree.

Figure 6:
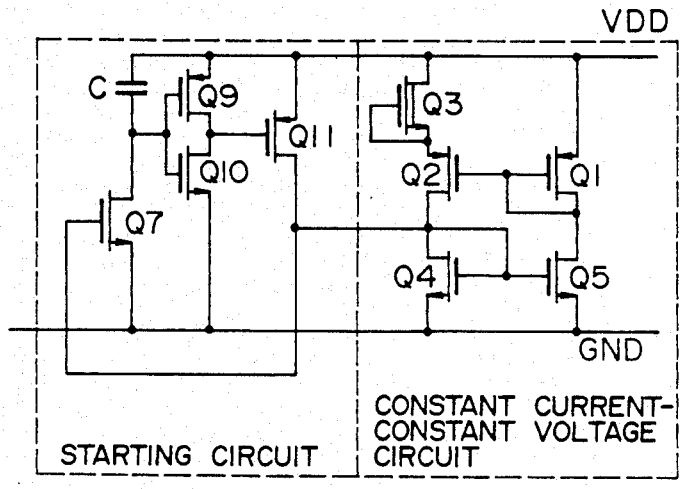
FIG. 6 is a circuit diagram of a constant current-constant voltage circuit according to still another embodiment of the present invention.

FIG. 6 is a circuit diagram of a constant current-constant voltage circuit according to still another embodiment of the present invention. The embodiment of FIG. 6 differs from the embodiment of FIG. 1 in that conductivity types of N channels and P channels of the MOSFETs $Q_1$ to $Q_5$ are inverted and the third MOSFET $Q_3$ is not the enhancement type but depletion type. The embodiment of FIG. 6 also differs from the embodiment of FIG. 1 in that the gate of the third MOSFET $Q_3$ is connected to the source thereof as a result of the change in conductivity type and a starting circuit including a capacitor C and MOSFETs $Q_7$ to $Q_{11}$ is connected to the gates of the MOSFETs $Q_4$ and $Q_5$.

Immediately after application of the power supply $V_{DD}$ to the starting circuit of FIG. 6, gates of the MOSFETs $Q_9$ and $Q_{10}$ forming an inverter are pulled up to the high level by the function of the capacitor C. As a result, the output of this inverter including $Q_9$ and $Q_{10}$ becomes the low level to make the P-channel MOSFET $Q_{11}$ conductive. Gate starting voltage is thus applied to the MOSFETs $Q_4$ and $Q_5$ of the constant current-constant voltage circuit.

Once currents have flown through the MOSFETs $Q_4$ and $Q_5$, the MOSFET $Q_7$ becomes conductive and hence the gates of the MOSFETs $Q_9$ and $Q_{10}$ forming the inverter become the low level. As a result, the output of the inverter including $Q_9$ and $Q_{10}$ becomes the high level and the P-channel MOSFET $Q_{11}$ becomes nonconductive. The starting operation of the constant current-constant voltage circuit conducted by this starting circuit is thus finished.

Figure 7:
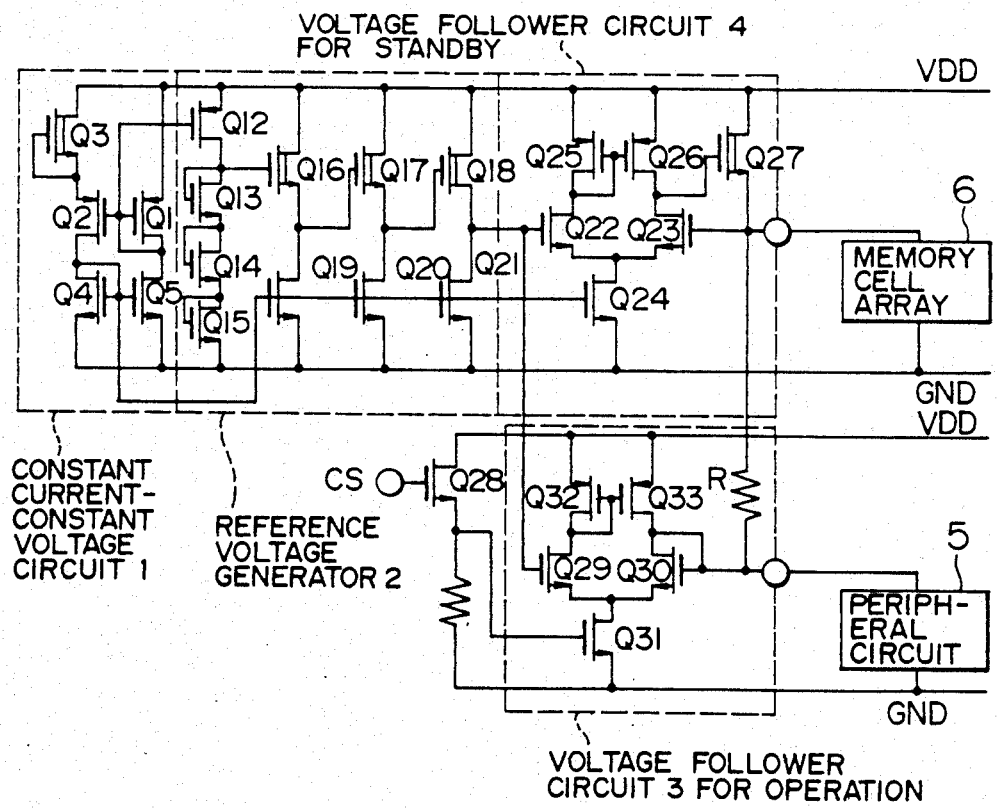
FIG. 7 shows an example of application of a constant current-constant voltage circuit according to an embodiment of the present invention to a semiconductor memory device.

FIG. 7 shows an example of application of a constant current-constant voltage circuit according to an embodiment of the present invention to a semiconductor memory device.

That is to say, MOSFETs constituting a memory cell array 6 and a peripheral circuit 5 must be made minute in order to raise the integration density of the semiconductor memory device. On the other hand, external power supply $V_{DD}$ of 5 volts cannot be directly supplied to the memory cell array 6 and the peripheral circuit 5 when a microcircuit technique using short channels in MOSFETs is employed. Therefore, it is necessary to feed the external power supply $V_{DD}$ of 5 volts to the memory cell array 6 and the peripheral circuit 5 after it has been stepped down within the semiconductor memory device.

In FIG. 7, a constant current-constant voltage circuit 1, a reference voltage generator 2, a voltage follower circuit 3 for operation and a voltage follower circuit 4 for standby are used for this internal stepping down.

That is to say, the constant current-constant voltage circuit 1 similar to that of FIG. 6 is used for setting a bias current of the reference voltage generator 2 and setting a bias current of the voltage follower circuit 4 for standby in the semiconductor memory device of FIG. 7.

That is to say, the gate of a P-channel MOSFET $Q_{12}$ included in the reference voltage generator 2 is biased stably by constant voltage of 4.5 volts generated by the constant current-constant voltage circuit 1 and hence stable voltage of 1.5 volt is generated by three diode-coupled N-channel MOSFETs $Q_{13}$ to $Q_{15}$. Constant voltage of 0.5 volt generated by the constant current-constant voltage circuit 1 is applied to three constant current MOSFETs $Q_{19}$ to $Q_{21}$ respectively connected to three N-channel source follower level shift circuits respectively including $Q_{16}$ to $Q_{18}$. Therefore, the level shift voltage of each of these three N-channel source follower level shift circuits respectively including $Q_{16}$ to $Q_{18}$ is also set at a stable value. Stable constant voltage of 3.9 volts is thus generated by the reference voltage generator 2.

The voltage follower circuit 4 for standby supplies the stable constant voltage of 3.9 volts fed from the reference voltage generator 2 to the memory cell array 6 with low output impedance. Since the constant voltage of 0.5 volt generated by the constant current-constant voltage circuit 1 is also applied to the gate of a constant current MOSFET $Q_{24}$ included in the voltage follower circuit 4 for standby, operation currents of N-channel differential MOSFETs $Q_{22}$ and $Q_{23}$ are set at stable values.

The constant voltage of 3.9 volts fed from the voltage follower circuit 4 for standby is supplied to the peripheral circuit 5 as well via a resistor R. This allows the peripheral circuit 5 to start its operation rapidly even after the voltage follower circuit 3 for operation is activated by a chip select signal CS which has become the high level. If the value of this resistor is infinite, the delay of the operation start of the peripheral circuit after the transition of the chip select signal CS to the high level is increased. On the other hand, there is a possibility of transmission of noises from the peripheral circuit 5 to the memory cell array 6 if the resistance value of the resistor R is zero.

If the chip select signal CS of high level is applied to the gate of a constant current MOSFET $Q_{31}$ included in the voltage follower circuit 3 for operation via a source follower N-channel MOSFET $Q_{28}$, the operation for supplying the constant voltage of 3.9 volts fed from the reference voltage generator 2 to the peripheral circuit 5 conducted by the voltage follower circuit 3 for operation is started.

It is a matter of course that the present invention is not limited to the above described concrete embodiments and various changes are possible within the scope of the technical concept thereof.

For example, the current mirror circuit of FIG. 1 including $Q_4$ and $Q_5$ may be replaced by PNP bipolar transistors. Further, the ratio between the input current and the output current of this current mirror circuit including $Q_4$ and $Q_5$ is not limited to 1:1, but an arbitrary ratio may be adopted.

It is a matter of course that a semiconductor integrated circuit device using the present invention is not limited to a semiconductor memory device, but the present invention may be applied to a ULSI having a microprocessor or a CPU mounted thereon as well.

The present invention makes it possible to provide a constant current-constant voltage circuit having decreased dependence upon temperature.

What is claimed is:

1. A constant current-constant voltage circuit comprising:

first and second MOSFETs having gates connected together;

a third MOSFET having a drain-source path connected to a source of said second MOSFET;

a current mirror circuit having an input connected to a drain of said second MOSFET and an output connected to a drain of said first MOSFET;

the gate of said first MOSFET being connected to the drain thereof;

a gate of said third MOSFET being connected to a predetermined operation potential point to make said third MOSFET operate in a linear region; and a first coefficient ($W_3L_2/L_3W_2$) depending upon channel lengths ($L_2$, $L_3$) and channel widths ($W_2$, $W_3$) of said second and third MOSFETs being set at a value not larger than a predetermined value.

2. A constant current-constant voltage circuit according to claim 1, wherein said first coefficient ($W_3L_2/L_3W_2$) is set at a value not larger than 0.1.

3. A constant current-constant voltage circuit according to claim 1, wherein said third MOSFET is enhancement type, and a second coefficient K ($=W_2L_1/W_1L_2$) depending upon channel widths ($W_1$, $W_2$) and channel lengths ($L_1$, $L_2$) of said first and second MOSFETs is set at a predetermined value whereas product $KW_3L_2/L_3W_2$ of said first coefficient ($W_3L_2/L_3W_2$) and said second coefficient K is set at 0.1 or less.

4. A constant current-constant voltage circuit according to claim 1, wherein said third MOSFET is depletion type and a second coefficient K ($=W_2L_1/W_1L_2$) depending upon channel widths ($W_1$, $W_2$) and channel lengths ($L_1$, $L_2$) of said first and second MOSFETs is set at a predetermined value whereas product $KW_3L_2/L_3W_2$ of said first coefficient $W_3L_2/L_3W_2$) and said second coefficient K is set at 0.4 or less.

* * * * *